US006870541B2

(12) United States Patent
Yamamoto et al.

(10) Patent No.: US 6,870,541 B2
(45) Date of Patent: Mar. 22, 2005

(54) RAM INCORPORATED DISPLAY DRIVER FOR REDUCING LOAD ON DISPLAY SCREEN CONTROL AND IMAGE DISPLAY APPARATUS INCLUDING THE SAME DISPLAY DRIVER

(75) Inventors: Ken Yamamoto, Yokohama (JP); Kiyoshi Hidaka, Yokohama (JP); Teruhisa Kudo, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 61 days.

(21) Appl. No.: 09/758,290

(22) Filed: Jan. 12, 2001

(65) Prior Publication Data

US 2001/0007453 A1 Jul. 12, 2001

(30) Foreign Application Priority Data

Jan. 12, 2000 (JP) ..... 2000-003553
Jan. 11, 2001 (JP) ..... 2001-3253

(51) Int. Cl.[7] ..... G09G 5/39

(52) U.S. Cl. ..... 345/531; 345/571; 345/684; 345/784; 345/533

(58) Field of Search ..... 345/684, 784, 345/685, 803, 168, 467, 764, 531, 533, 571, 160, 502

(56) References Cited

U.S. PATENT DOCUMENTS 4,769,637 A * 9/1988 Forrester et al. ..... 345/590
5,250,928 A * 10/1993 Kuriki ..... 345/593
5,495,267 A * 2/1996 Fujitaka ..... 345/685
5,909,206 A * 6/1999 Yokota et al. ..... 345/98

FOREIGN PATENT DOCUMENTS

JP 9-16118 1/1997
JP 11-212540 8/1999

* cited by examiner

*Primary Examiner*—Kimbinh T. Nguyen
(74) *Attorney, Agent, or Firm*—Oblon, Spivak, McClelland, Maier & Neustadt, P.C.

(57) ABSTRACT

This invention provides an image display apparatus for displaying data stored in a random access memory (RAM) such as LCD, more specifically a display driver achieving easy and flexible display control such as scroll in a display screen without increasing load on CPU and an image display apparatus including the same. This display driver comprises an RAM for storing the display data to be displayed on the display screen, a latch shift register for receiving the display data read out from the RAM and if the display screen is intended to be scrolled in a horizontal direction, shifting the read out display data depending on the scrolling direction and if the display screen is intended to be scrolled in a vertical direction, holding the read out display data and an access control circuit for reading out the display data from the RAM and if the display screen is intended to be scrolled in a horizontal direction, writing back the display data shifted by the latch shift register into an original position in the RAM and if the display screen is intended to be scrolled in a vertical direction, writing back the display data held by the latch shift register from the original position of the RAM to a position shifted by the amount of the scroll.

12 Claims, 5 Drawing Sheets

RAM INCORPORATED DISPLAY DRIVER FOR REDUCING LOAD ON DISPLAY SCREEN CONTROL AND IMAGE DISPLAY APPARATUS INCLUDING THE SAME DISPLAY DRIVER

CROSS-REFERENCE TO RELATED APPLICATION

This application is based upon and claims the benefit of priority under 35USC section 119 to the prior Japanese patent Application No. 2000-3553, filed Jan. 12, 2000; and prior Japanese patent Application No. 2001-3253, filed Jan. 11, 2001; the entire contents of which are incorporated herein by reference.

BACKGROUND OF THE INVENTION

1. Field of the Invention

The present invention relates to an RAM incorporated display driver for reducing load on display screen control and an image display apparatus including the same display driver. More specifically, the present invention relates to an image display apparatus, such as an LCD, for displaying data stored in a random access memory (RAM) in which display screen control such as easy, flexible scroll is achieved without increasing CPU load in the system.

2. Background Art

Conventionally, there has been an image display apparatus, which displays data stored in an incorporated random access memory temporarily on a display unit, such as a liquid crystal display (LCD). In such an image display apparatus, scroll of its display screen is carried out by system CPU including the liquid crystal display.

Particularly, a mobile terminal apparatus such as a cellular phone includes a number of functions which the CPU should achieve and operations which the CPU should execute to achieve recently prevailing color display functions, and these number of functions have been increased, so that load on the CPU has been increased more and more.

In the conventional image display apparatus, the system CPU controls the display operation of the display screen including scroll function. For this reason, the load on the CPU is increased, so that time consumed for other processing than the image display has been shortened, or processing other than image display processing is sometimes delayed. Further, the CPU is demanded to have a higher throughput, thereby increasing CPU development cost.

SUMMARY OF THE INVENTION

An object of the present invention is to provide an image display apparatus such as a liquid crystal display, which displays data on a display screen stored in an incorporated random access memory temporarily, and more specifically an RAM incorporated display driver which achieves reduction of load on system CPU's image display control by scrolling a display screen by means of a system driver for driving the display such as the liquid crystal display and an image display apparatus including the same.

Another object of the present invention is to achieve easy and flexible scroll of the display screen in a vertical direction and in a horizontal direction by means of the system driver for driving the display such as the liquid crystal display.

To achieve the above object, according to an aspect of the present invention, there is provided a random access memory (RAM) incorporated display driver for displaying display data stored in the incorporated RAM on a display screen, comprising:

a RAM configured to store the display data to be displayed on the display screen; a latch shift register configured to receive the display data read out from said RAM and if said display screen is intended to be scrolled in a horizontal direction, shift said read out display data depending on the scrolling direction and if said display screen is intended to be scrolled in a vertical direction, hold said read out display data; and an access control circuit configured to read out the display data from said RAM and if said display screen is intended to be scrolled in a horizontal direction, write back the display data shifted by said latch shift register into an original region in said RAM and if said display screen is intended to be scrolled in a vertical direction, write back the display data held by said latch shift register into a region moved by the amount of the scroll from the original region of said RAM.

Preferably, the access control circuit comprises a switching circuit configured to switch a direction for reading out the display data from said RAM serially to an opposite direction, if the display screen is intended to be scrolled vertically downward, to that of scrolling the display screen vertically upward.

Preferably, the RAM incorporated display driver according to claim 1, further comprising a first selecting circuit configured to select a region in a horizontal direction capable of being scrolled in the display screen, wherein said access control circuit supplies display data in a region selected by said first selecting circuit to said latch shift register.

Preferably, the RAM incorporated display driver according to claim 1, further comprising a second selecting circuit configured to select a region in a vertical direction capable of being scrolled in the display screen, wherein said access control circuit supplies display data in a region selected by said second selecting circuit to said latch shift register.

Preferably, the first selecting circuit includes a shift register of the same bit number as that of one dot line of said RAM.

Preferably, the second selecting circuit includes a comparing circuit configured to compare a value of an address in a vertical direction to be scrolled with a content of an address counter indicating a selected address in the vertical direction in said RAM.

Preferably, the display is a liquid crystal display (LCD).

According to another aspect of the present invention, there is provided an image display apparatus for displaying display data stored in the incorporated RAM, comprising: a display; a system driver for driving said display; and a CPU for supplying a signal for controlling the display screen to said system driver, wherein said system driver includes: a RAM configured to store the display data to be displayed on the display screen; a latch shift register for receiving the display data read out from said RAM and if said display screen is intended to be scrolled in a horizontal direction, shift said read out display data depending on the scrolling direction and if said display screen is intended to be scrolled in a vertical direction, hold said read out display data; and an access control circuit configured to read out he display data from said RAM and if said display screen is intended to be scrolled in a horizontal direction, write back the display data shifted by said latch shift register into an original region in said RAM and if said display screen is intended to be scrolled in a vertical direction, write back the display data held by said latch shift register into a region moved by the amount of the scroll from the original region of said RAM.

According to still another aspect of the present invention, there is provided a memory incorporated display driver for displaying display data stored in the incorporated memory on a display screen, comprising: a memory configured to store the display data to be displayed on the display screen; a latch shift unit configured to receive the display data read out from said memory and if said display screen is intended to be scrolled in a lateral direction, shift said read out display data depending on the scrolling direction and if said display screen is intended to be scrolled in a longitudinal direction, hold said read out display data; and an access control unit configured to read out the display data from said memory and if said display screen is intended to be scrolled in a lateral direction, write back the display data shifted by said latch shift unit into an original region in said memory and if said display screen is intended to be scrolled in a longitudinal direction, write back the display data held by said latch shift unit into a region moved by the amount of the scroll from the original region of said memory, whereby said written back display data is supplied to said display screen by said access control unit.

Various further and more specific objects, features and advantages of the invention will appear from the description given below, taken in conjunction with the accompanying drawings illustrating by way of example preferred embodiments of the invention.

DETAILED DESCRIPTION OF THE PREFERRED EMBODIMENTS

Hereinafter, an RAM incorporated display driver for reducing load on display screen control and an image display apparatus including the same display driver of the present invention will be described in detail with reference to FIGS. 1 to 8.

First Embodiment

An RAM incorporated display driver for reducing load on display screen control and an image display apparatus including the same display driver according to a first embodiment will be described in detail with reference to FIGS. 1 to 5.

The first embodiment is an image display apparatus such as a liquid crystal display unit for displaying display data memorized temporarily in an incorporated random access memory (RAM) on a display. This image display apparatus has a function of shifting or latching the display data memorized in the incorporated RAM in a scroll direction in a system driver for driving a display such as liquid crystal display and then outputting the display data sent back to the RAM depending on the amount of the scroll on the display.

Figure 1:
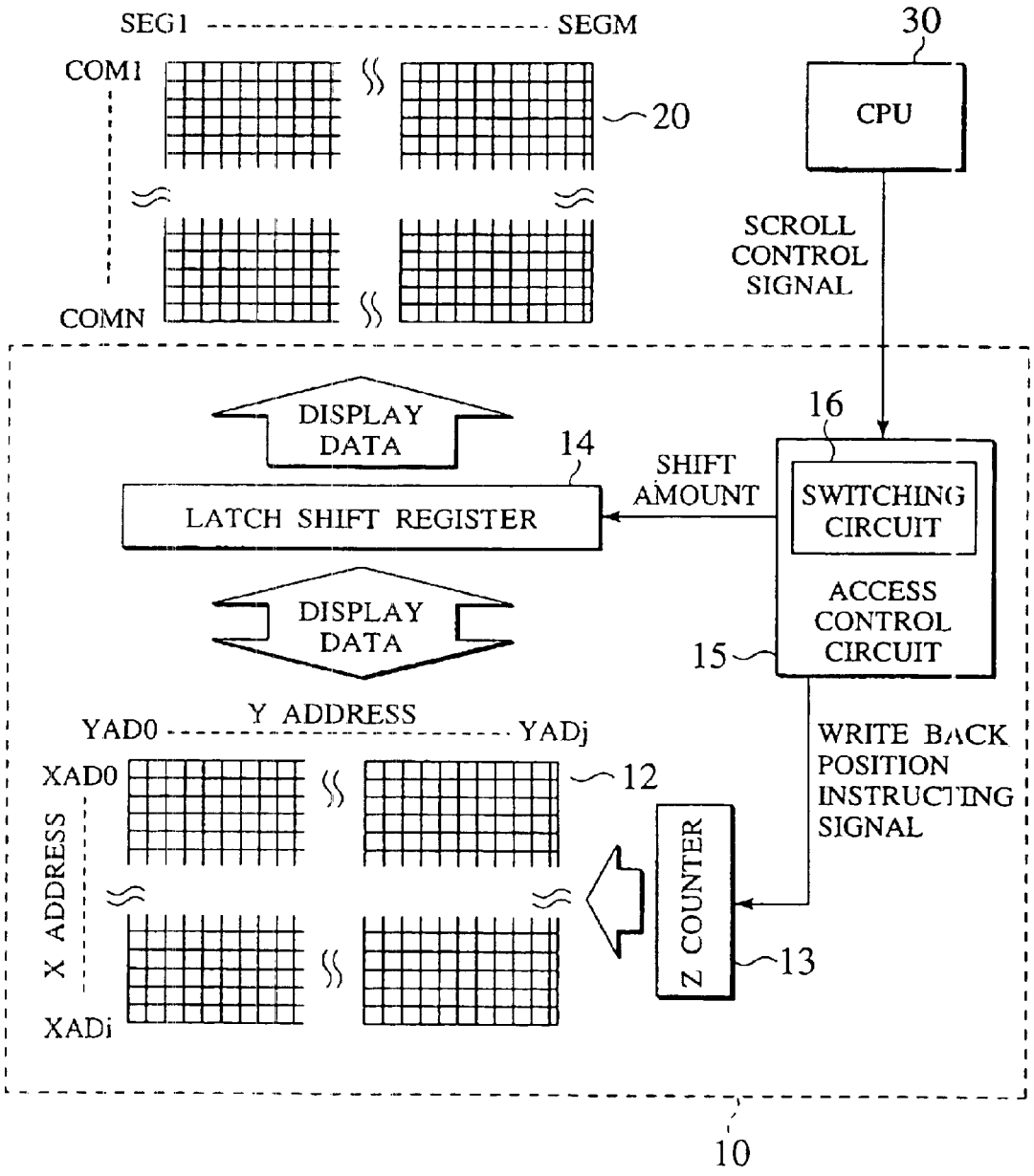
FIG. 1 is a diagram showing a structure of an RAM incorporated system driver according to a first embodiment of the present invention.

FIG. 1 is a diagram showing the structure of the RAM incorporated display driver and image display apparatus according to the first embodiment of the present invention.

Referring to FIG. 1, the image display apparatus of the first embodiment comprises a system driver 10, a display unit 20 composed of, for example, liquid crystal display (LCD), and a CPU 30 mounted in the system for supplying a screen control signal to the system driver 10 to output the display data on the display unit 20.

The system driver 10 includes an incorporated random access memory 12, a Z counter 13, a latch shift register 14, an access control circuit 15 and a switching circuit 16.

The incorporated RAM 12 stores display data to be displayed on a display screen of the display unit 20 composed of, for example, LCD.

The Z counter 13 reads display data corresponding to 1 dot line in the display unit 20 synchronously according to a control signal from an access control circuit 15.

The latch shift register 14 (hereinafter referred to as shift register) sends or receives the display data to/from the incorporated RAM 12 and holds or shifts the display data.

The access control circuit 15 reads out the display data successively from the incorporated RAM 12 depending on the amount of a scroll of the display screen based on a screen control signal from the CPU 30, for example, a signal for instructing a scroll in a predetermined amount of the display screen and then, writes back the display data shifted or held by the shift register 14 into the incorporated RAM 12. The access control circuit 15 supplies the display data written back into the incorporated RAM 12 to the display unit 20.

The switching circuit 16 switches the order of data reading from the incorporated RAM 12 corresponding to up/down scroll direction (vertical direction; X direction in FIG. 1) of the display screen.

Next, a screen control operation of the system driver according to the first embodiment will be described about its display scroll, for example.

(1) Lateral Direction (Horizontal Direction; Y Direction) Scroll

Figure 2:
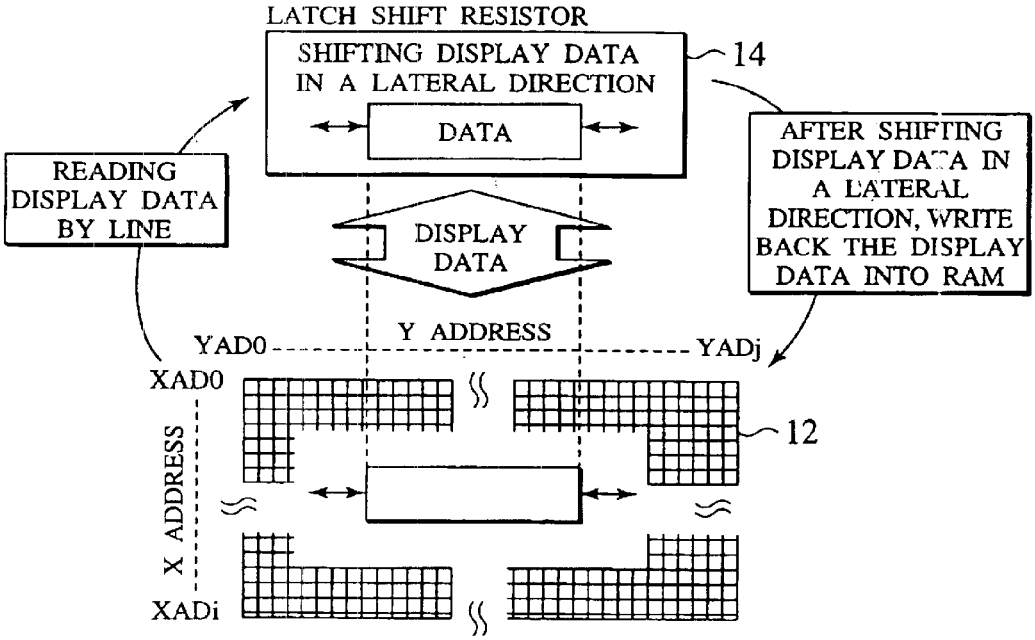
FIG. 2 is a diagram showing I/O condition of display data in lateral (horizontal) scroll according to the first embodiment.

FIG. 2 describes lateral scroll of the display screen by a system driver according to the first embodiment.

As shown in FIGS. 1 and 2, the access control circuit 15 stores display data in the incorporated RAM 12. Next, the access control circuit 15 reads out (scans) display data in the incorporated RAM 12 from address XAD0 (or XADi) by each dot line and supplies the display data to the shift register 14.

The read out display data is shifted to the left direction or right direction by the shift register 14 by a scroll amount according to a signal indicating the shift amount and shift direction given from the access control circuit 15. The access control circuit 15 supplies the signal for indicating a shift amount and shift direction to the shift register 14, based on a scroll control signal for instructing a scroll by a predetermined amount in a lateral direction, given by the system CPU 30. The shifted display data is written back to the same line as that of the read display data in the incorporated RAM 12 by the access control circuit 15.

In FIG. 2, it is permissible to bury "0" or "1" in each of dots shifted in the right direction from YAD0 or in the left direction form YADj, or it is permissible to write new data only into those dots from the CPU 30.

The above-mentioned operation is carried out by 1 dot line for all lines in the order of 0 to i or i to 0 in terms of X address. Data written back into the incorporated RAM 12 in this way is supplied to and displayed on the display unit 20 by the access control circuit 15, so that a screen scrolled in the lateral direction relative to its original screen is displayed on the display unit 20.

(2) Longitudinal Direction (Vertical Direction; X Direction) Scroll

Figures 3A, 3B:
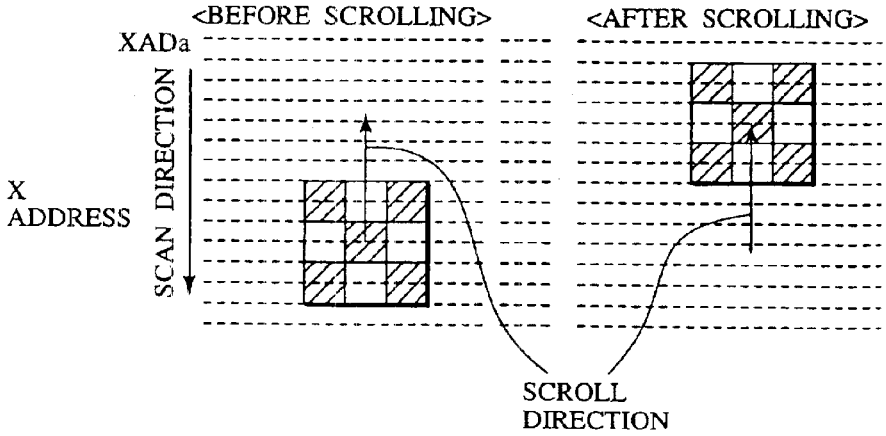
FIG. 3 is a diagram showing a transition of a display screen by longitudinally upward (vertically upward) scroll according to the first embodiment.
Figure 4:
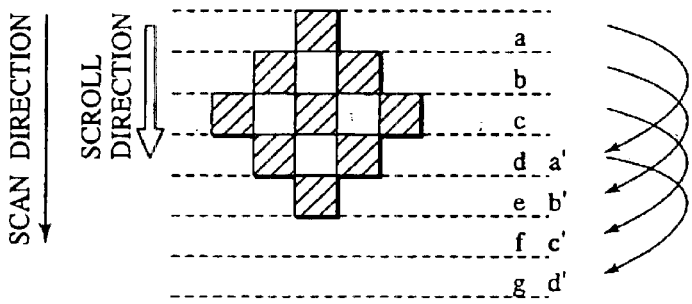
FIG. 4 is a diagram showing a transition of a display screen by longitudinally downward (vertically downward) scroll according to the first embodiment.
Figures 5A, 5B:
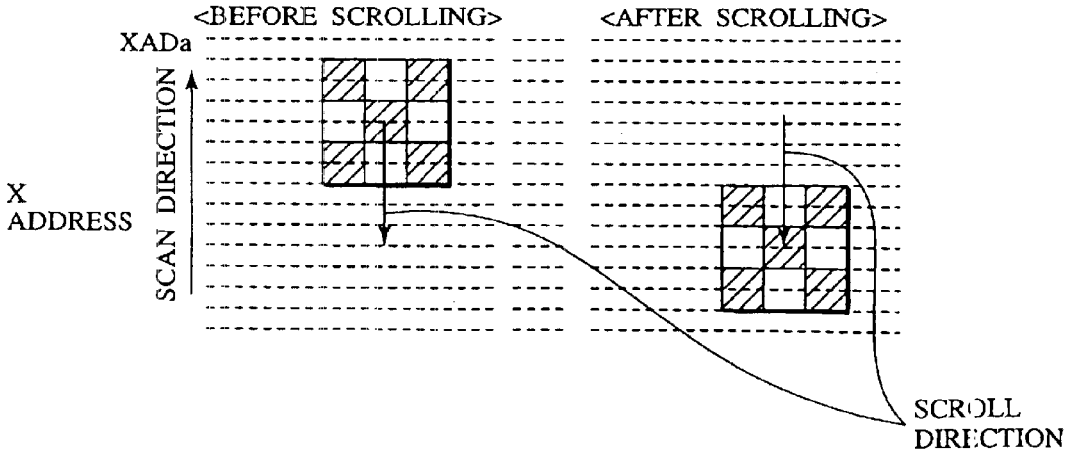
FIG. 5 is a diagram showing a transition of a display screen by longitudinally downward (vertically downward) scroll according to the first embodiment.

FIGS. 3 to 5 describe an operation of longitudinal scroll of the display screen by the system driver according to the first embodiment.

First, the upward scroll of the display screen will be described.

When scrolling the display screen upward as shown in FIGS. 1, 3A, 3B, the access control circuit 15 reads out (scans) display data of 1 dot line on the display screen, stored in the incorporated RAM 12 and supplies it to the shift register 14. The shift register 14 holds the read out display data of 1 dot line.

The display data held by the shift register 14 is written back into an X address in the incorporated RAM 12 moved by an amount desired to be scrolled upward from a read out X address. The access control circuit 15 determines a write back address for the display data in the incorporated RAM 12 based on a scroll control signal for instructing longitudinally upward scroll by a predetermined amount, supplied by the system CPU 30.

The above-mentioned operation is carried out for all lines of the X address in the order of XAD0 to XADi in terms of the address of the incorporated RAM 12. The data written back into the incorporated RAM 12 is supplied to and displayed on the display unit 20 so that a screen scrolled upward relative to its original screen is displayed.

Next, the downward scroll of the display screen will be described.

When scrolling the display screen downward, if by scanning data in the order of address XAD0 to address XADi in the incorporated RAM 12 like a case of upward scroll, the display data from 1 line of address XAD0 to 1 line of address XADi is transferred successively within the incorporated RAM 12, data which should be displayed is overwritten.

That is, as shown in FIG. 4, for example, data of line a is transferred to lined, and before data of lined is transferred, data of line d is overwritten, so that data of line d cannot be scrolled. This is the same for lines e, f, g.

According to the first embodiment, to avoid this inconvenience, scrolling downward is carried out by reading (scanning) display data from the incorporated RAM 12 in the order from address XADi to XAD0, which is reverse to the upward scroll. More specifically, when scrolling downward is intended, the switching circuit 16 switches the scanning direction of the incorporated RAM 12 to be executed by the access control circuit 15, based on a signal for instructing a scroll direction inputted from the system CPU 30.

Therefore, when downward scroll is intended, the access control circuit 15 switches the direction of scanning the incorporated RAM 12 based on an instruction from the switching circuit 16, otherwise, same as upward scroll, the access control circuit 15 operates as described above. As a result, the downward scroll is carried out accurately.

According to the first embodiment, the following effect is achieved.

That is, the access control circuit 15 reads out display data from the incorporated RAM 12 and supplies the display data to the shift register 14. When scrolling the display screen in a lateral direction, display data shifted by the shift register 14 is written back into read-out X address in the incorporated RAM 12. Otherwise, when scrolling the display screen in a longitudinal direction, the display data held by the shift register is written back into X address shifted by a shift amount from a read-out X address in the incorporated RAM 12. The display data written back into the incorporated RAM 12 is supplied to and displayed on the display screen by the access control circuit 15.

The display data is written back into the incorporated RAM 12 after scroll temporarily, then the written back display data is displayed. As compared to supplying the display data directly to the display screen after a shift operation in the shift register, a load on the shift register 14 in the display driver 10 can be reduced. At the same time, lateral scroll can be achieved easily as well as longitudinal scroll.

As a result, various scrolls of the display screen such as the liquid crystal display can be achieved as the function of the display driver, so that the load on the CPU for driving the display screen can be reduced.

Second Embodiment

Hereinafter, the second embodiment of the RAM incorporated display driver for reducing load on the display screen control and the image display apparatus including the same display driver of the present invention will be described about only a different point from the first embodiment, with reference to FIGS. 6 to 8.

The second embodiment provides the function of partial scroll for scrolling selectively part of the display screen in the lateral direction and longitudinal direction as compared to the RAM incorporated display driver of the first embodiment.

Figure 6:
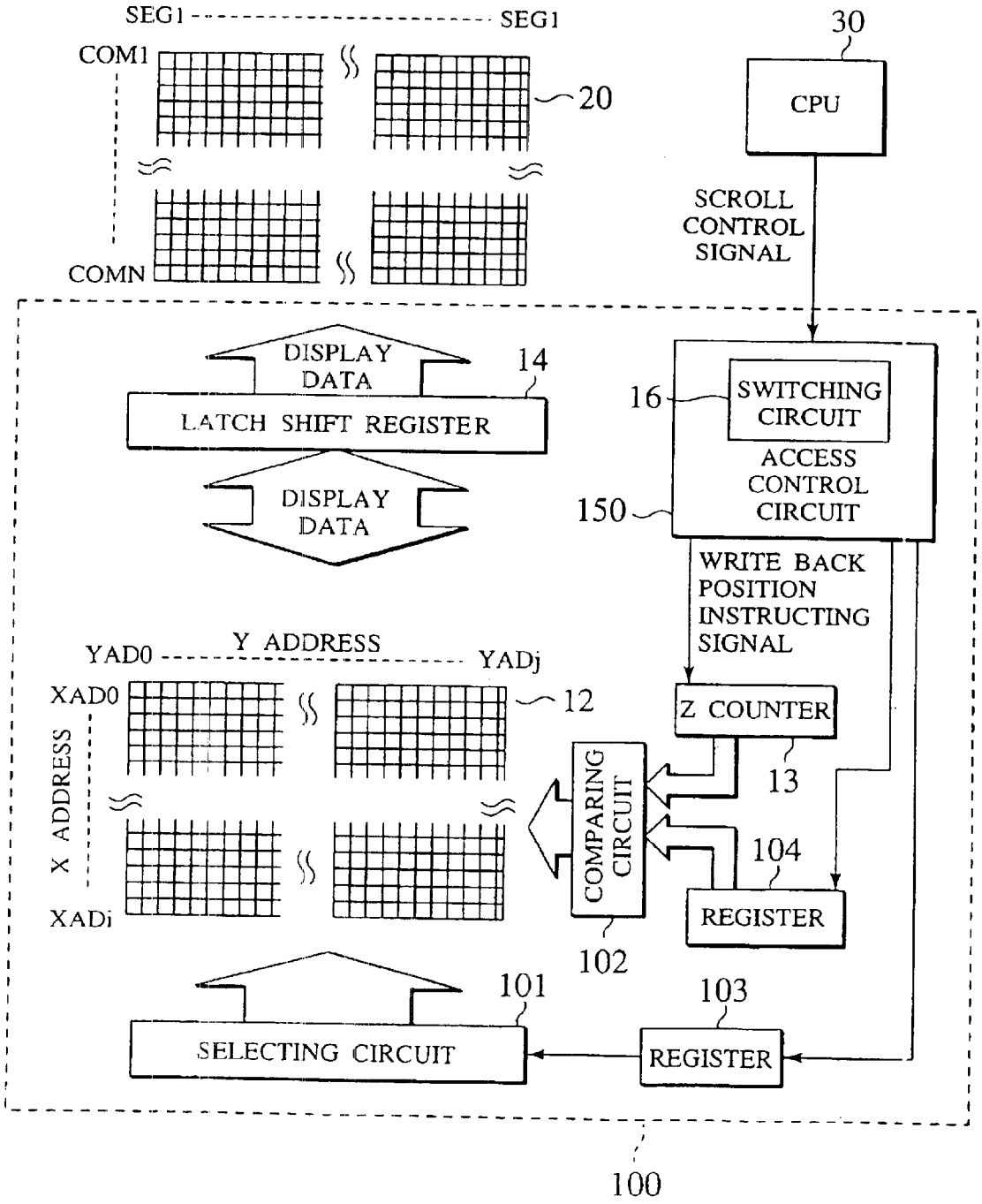
FIG. 6 is a diagram showing the structure of RAM incorporated system driver according to a second embodiment of the present invention.

FIG. 6 is a diagram showing the structure of the RAM incorporated system driver for the LCD according to the second embodiment of the present invention.

As shown in FIG. 6, the RAM incorporated display driver according to the second embodiment comprises a selecting circuit 101, a comparing circuit 102 and registers 103, 104 as compared to the structure of the first embodiment shown in FIG. 1.

The selecting circuit 101 selects and instructs a region in the lateral direction desired to be scrolled in the display screen 20. The access control circuit 150 shifts the display data in a region in a lateral direction selected and instructed by the selecting circuit 101 by means of the shift register 14 and writes back the shifted display data into the incorporated RAM 12. The selecting circuit 101 is, for example, composed of a shift register of the same bit number (j+1) as that of one line of the incorporated RAM 12 shown in FIG. 7.

The comparing circuit 102 functions as a selecting circuit for selecting and instructing a region in the longitudinal direction desired to be scrolled in the display screen 20 together with the Z counter 13 and register 104.

(1) Partial Scroll in Lateral Direction

Figure 7:
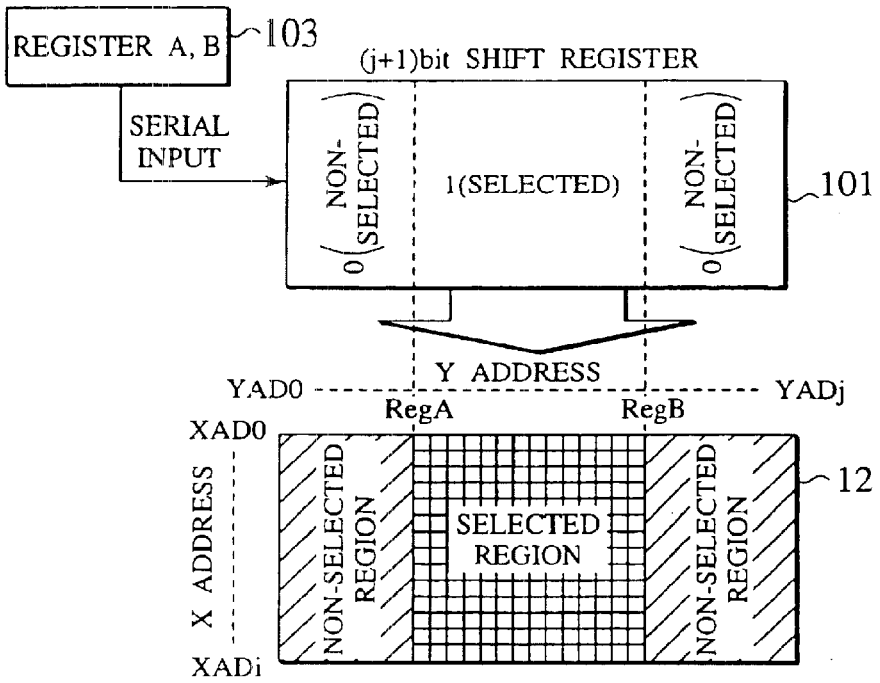
FIG. 7 is a diagram showing a screen selection condition when scrolling selectively a region in lateral direction (horizontal direction) of the display screen according to the second embodiment.

As shown in FIG. 7, for example, "1" which specifies a selected region and for example, "0" which specifies a non-selected region are inputted from the register 103 into the selecting circuit 101 serially and set therein.

Next, Y address RegA–RegB region in the incorporated RAM 12 corresponding to the selecting circuit 101 in which "1" is set is selected and turns to an access region. On the other hand, Y address region in the incorporated RAM 12 corresponding to the selecting circuit 101 in which "0" is set is set as not selected and turns to a non-access region. That is, the access control circuit 150 controls the access region of the incorporated RAM 12 according to data set in the selecting circuit 101. As a result, the selected region in the incorporated RAM 12 sends or receives display data to/from the shift register 14 like the above-described first embodiment, so that the scroll is carried out. On the other hand, the non-selected region in the incorporated RAM 12 does not exchange the display data with the shift register 14, so that no scroll is carried out.

(2) Partial Scroll in Longitudinal Direction

Figure 8:
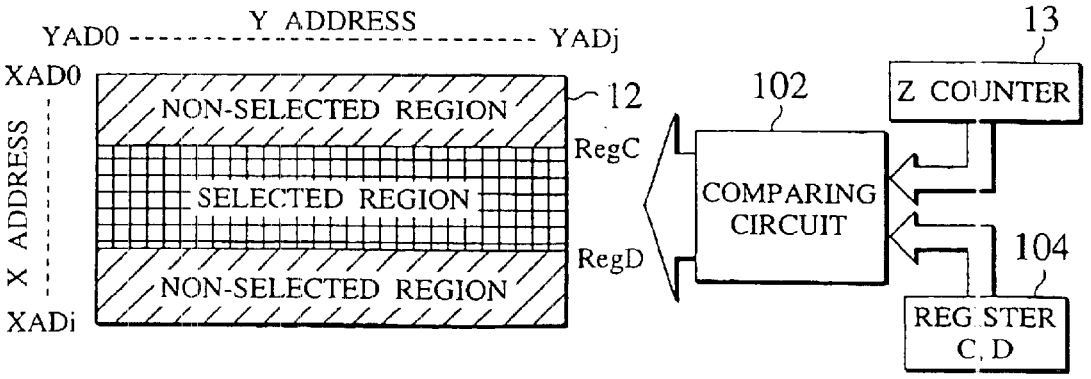
FIG. 8 is a diagram showing a screen selection condition when scrolling selectively a region in longitudinal direction (vertical direction) of the display screen according to the second embodiment.

As shown in FIG. 8, the comparing circuit 102 compares the value at X address RegC–RegD of the incorporated RAM 12 desired to be scrolled, set in the register 104 with the content of the Z counter 13. A region in which both coincide is selected to be an access region and the other region is not selected, so that it turns to be non-access region. That is, if the content of the Z counter 13 is within a range of RegC–RegD when the incorporated RAM 12 is accessed synchronously with the content outputted from the Z counter 13, the content of the Z counter 13 is enabled so that the RAM 12 is accessed. On the other hand, if the content of the Z counter 13 is out of the range from RegC to RegD, the content of the Z counter 13 is disabled so that the incorporated RAM 12 is not accessed. Consequently, in a selected region in the incorporated RAM, the display data is sent or received to/from the shift register 14 like the above described first embodiment, so that the scroll is performed. On the other hand, in a non-selected region in the incorporated RAM 12, the display data is not set or received to/from the shift register 14, so that no scroll is performed.

According to the second embodiment, the same effect as the first embodiment is achieved and further, the display screen can be scrolled selectively by the display driver. Further, in complicated scroll control on the screen, data traffic between the system driver and system CPU can be suppressed, so that the load on the system is reduced.

According to the above described embodiments, the system driver may be constructed on one chip or composed of a common driver and segment driver. In the latter case, the incorporated RAM 12, Z counter 13, the latch shift register 14, the access control circuit 15 and 150, and so on, may be integrated in the same chip as that of the segment driver.

The image display unit of the above embodiments may include general display capable of displaying an image on its display unit as well as liquid crystal display (LCD), electro luminescence (EL) and the like.

Although according to the above embodiments, the screen display control has been described about the scroll function, the present invention can be applied widely to every screen display control such as blinking control, reversing control, color display control and gradation control.

In summary, according to the present invention, the system driver for driving the display unit such as the liquid crystal display is provided with the scroll function for the display screen. As a result, the load on the CPU for driving the display screen can be reduced.

Various modifications will become possible for those skilled in the art after receiving the teachings of the present disclosure without departing from the scope thereof. It is intended, therefore, that all matter contained in the foregoing description and in the drawings shall be interpreted as illustrative only not as limitative of the invention.

What is claimed is:

1. A random access memory (RAM) incorporated display driver for displaying display data stored in the incorporated RAM on a display screen, comprising:

a RAM configured to store the display data to be displayed on the display screen;

a latch shift register configured to receive the display data read out from said RAM and if said display screen is intended to be scrolled in a horizontal direction, shift said read out display data depending on the scrolling direction and if said display screen is intended to be scrolled in a vertical direction, hold said read out display data;

an access control circuit configured to read out the display data from said RAM, send the read out display data to said latch shift register, and if said display screen is intended to be scrolled in a horizontal direction, write back the display data shifted by said latch shift register into an original region in said RAM and if said display screen is intended to be scrolled in a vertical direction, write back the display data held by said latch shift register into a region in said RAM moved by the amount of the scroll from the original region of said RAM, and supply the written back display data in said RAM to said display screen according to a screen control signal supplied by a CPU configured outside of the display driver; and a selecting circuit configured to select a region in a horizontal direction capable of being scrolled in the display screen, wherein said access control circuit supplies display data in a region selected by said selecting circuit to said latch shift register.

2. The RAM incorporated display driver according to claim 1, wherein said selecting circuit includes a shift register of the same bit number as that of one dot line of said RAM.

3. A random access memory (RAM) incorporated display driver for displaying display data stored in the incorporated RAM on a display screen, comprising:

a RAM configured to store the display data to be displayed on the display screen;

a latch shift register configured to receive the display data read out from said RAM and if said display screen is intended to be scrolled in a horizontal direction, shift said read out display data depending on the scrolling direction and if said display screen is intended to be scrolled in a vertical direction, hold said read out display data;

an access control circuit configured to read out the display data from said RAM, send the read out display data to said latch shift register, and if said display screen is intended to be scrolled in a horizontal direction, write back the display data shifted by said latch shift register into an original region in said RAM and if said display screen is intended to be scrolled in a vertical direction, write back the display data held by said latch shift register into a region in said RAM moved by the amount of the scroll from the original region of said RAM, and supply the written back display data in said RAM to said display screen according to a screen control signal supplied by a CPU configured outside of the display driver; and a selecting circuit configured to select a region in a vertical direction capable of being scrolled in the display screen, wherein said access control circuit supplies display data in a region selected by said selecting circuit to said latch shift register.

4. The RAM incorporated display driver according to claim 3, wherein said selecting circuit includes a comparing circuit configured to compare a value of an address in a vertical direction to be scrolled with a content of an address counter indicating a selected address in the vertical direction in said RAM.

5. An image display apparatus for display data stored in an incorporated RAM, comprising:

a display;

a system driver for driving said display; and a CPU for supplying a signal for controlling the display screen to said system driver, wherein said system driver includes:

a RAM configured to store the display data to be displayed on the display screen;

a latch shift register configured to receive the display data read out from said RAM and if said display screen is intended to be scrolled in a horizontal direction, shift said read out display data depending on the scrolling direction and if said display screen is intended to be scrolled in a vertical direction, hold said read out display data; and an access control circuit configured to read out the display data from said RAM, send the read out display data to said latch shift register, and if said display screen is intended to be scrolled in a horizontal direction, write back the display data shifted by said latch shift register into an original region in said RAM and if said display screen is intended to be scrolled in a vertical direction, write back the display data held by said latch shift register into a region in said RAM moved by the amount of the scroll from the original region of said RAM, and supply the written back display data in said RAM to said display screen according to a screen control signal supplied by a CPU configured outside of the display driver; and a selecting circuit configured to select a region in a horizontal direction capable of being scrolled in the display screen, wherein said access control circuit supplies display data in a region selected by said selecting circuit to said latch shift register.

6. The image display apparatus according to claim 5, wherein said selecting circuit includes a shift register of the same bit number as that of one dot line of said RAM.

7. An image display apparatus for display data stored in an incorporated RAM, comprising:

a display;

a system driver for driving said display; and a CPU for supplying a signal for controlling the display screen to said system driver, wherein said system driver includes:

a RAM configured to store the display data to be displayed on the display screen;

a latch shift register configured to receive the display data read out from said RAM and if said display screen is intended to be scrolled in a horizontal direction, shift said read out display data depending on the scrolling direction and if said display screen is intended to be scrolled in a vertical direction, hold said read out display data; and an access control circuit configured to read out the display data from said RAM, send the read out display data to said latch shift register, and if said display screen is intended to be scrolled in a horizontal direction, write back the display data shifted by said latch shift register into an original region in said RAM and if said display screen is intended to be scrolled in a vertical direction, write back the display data held by said latch shift register into a region in said RAM moved by the amount of the scroll from the original region of said RAM, and supply the written back display data in said RAM to said display screen according to a screen control signal supplied by a CPU configured outside of the display driver; and a selecting circuit configured to select a region in a vertical direction capable of being scrolled in the display screen, wherein said access control circuit supplies display data in a region selected by said selecting circuit to said latch shift register.

8. The image display apparatus according to claim 7, wherein said selecting circuit includes a comparing circuit configured to compare a value of an address in a vertical direction to be scrolled with a content of an address counter indicating a selected address in the vertical direction in said RAM.

9. A memory incorporated display driver for displaying display data stored in the incorporated memory on a display screen, comprising:

a memory configured to store the display data to be displayed on the display screen;

a latch shift register configured to receive the display data read out from said memory and if said display screen is intended to be scrolled in a horizontal direction, shift said read out display data depending on the scrolling direction and if said display screen is intended to be scrolled in a vertical direction, hold said read out display data; and an access control circuit configured to read out the display data from said memory, send the read out display data to said latch shift register, and if said display screen is intended to be scrolled in a horizontal direction, write back the display data shifted by said latch shift register into an original region in said memory and if said display screen is intended to be scrolled in a vertical direction, write back the display data held by said latch shift register into a region in said memory moved by the amount of the scroll from the original region of said memory, and supply the written back display data in said memory to said display screen according to a screen control signal supplied by a CPU configured outside of the display driver; and a selecting unit configured to select a region in a lateral direction capable of being scrolled in the display screen, wherein said access control unit supplies display data in a region selected by said selecting unit to said latch shift unit.

10. The memory incorporated display driver according to claim 9, wherein said selecting unit includes a shift register of the same bit number as that of one dot line of said memory.

11. A memory incorporated display driver for displaying display data stored in the incorporated memory on a display screen, comprising:

a memory configured to store the display data to be displayed on the display screen;

a latch shift register configured to receive the display data read out from said memory and if said display screen is intended to be scrolled in a horizontal direction, shift said read out display data depending on the scrolling direction and if said display screen is intended to be scrolled in a vertical direction, hold said read out display data; and an access control circuit configured to read out the display data from said memory, send the read out display data to said latch shift register, and if said display screen is intended to be scrolled in a horizontal direction, write back the display data shifted by said latch shift register into an original region in said memory and if said display screen is intended to be scrolled in a vertical direction, write back the display data held by said latch shift register into a region in said memory moved by the amount of the scroll from the original region of said memory, and supply the written back display data in said memory to said display screen according to a screen control signal supplied by a CPU configured outside of the display driver; and a selecting unit configured to select a region in a longitudinally direction capable of being scrolled in the display screen, wherein said access control unit supplies display data in a region selected by said second selecting unit to said latch shift unit.

12. The memory incorporated display driver according to claim 11, wherein said selecting unit includes a comparator configured to compare a value of an address in a longitudinal direction to be scrolled with a content of an address counter indicating a selected address in the longitudinal direction in said memory.

* * * * *

UNITED STATES PATENT AND TRADEMARK OFFICE

CERTIFICATE OF CORRECTION

PATENT NO. : 6,870,541 B2
APPLICATION NO. : 09/758290
DATED : March 22, 2005
INVENTOR(S) : Yamamoto et al.

It is certified that error appears in the above-identified patent and that said Letters Patent is hereby corrected as shown below:

On the title page, Item (30), the Foreign Application Priority Data should read:

-- (30) Foreign Application Priority Data

Jan. 12, 2000 (JP) ……..2000-003553 --

Signed and Sealed this

Fourth Day of March, 2008

JON W. DUDAS
*Director of the United States Patent and Trademark Office*